United States Patent [19]

Essele

[11] Patent Number: 5,049,425

[45] Date of Patent: Sep. 17, 1991

[54] POROUS YARN FOR OMS PINTLES

[75] Inventor: Klaus M. Essele, Clifton Park, N.Y.

[73] Assignee: Abany International Corporation, Menands, N.Y.

[21] Appl. No.: 293,329

[22] Filed: Jan. 4, 1989

[51] Int. Cl.[5] ..... B32B 1/06; B32B 1/08; F16G 3/02; F16G 3/14

[52] U.S. Cl. ..... 428/36.1; 24/33 P; 57/200; 57/224; 162/348; 162/358; 198/846; 428/36.3; 428/222; 428/377; 474/255

[58] Field of Search ..... 24/33 P; 57/200, 224; 162/DIG. 1; 428/222, 376, 377, 36.1, 36.3; 474/255

[56] References Cited

U.S. PATENT DOCUMENTS

| | | | |
|---|---|---|---|
| 1,531,862 | 3/1925 | Larned | 57/200 |
| 2,915,110 | 12/1959 | Ferguson et al. | 428/377 |
| 4,024,605 | 5/1977 | Henke | 24/33 P |
| 4,362,776 | 12/1982 | Lefferts et al. | 428/222 |
| 4,436,132 | 3/1984 | Cesar et al. | 57/224 |
| 4,500,590 | 2/1985 | Smith | 428/222 |
| 4,650,709 | 3/1987 | Lefferts | 428/222 |
| 4,671,403 | 6/1987 | Schick | 474/255 |
| 4,761,329 | 8/1988 | Halker et al. | 428/222 |
| 4,806,082 | 2/1989 | Penven | 24/33 P |
| 4,940,630 | 7/1990 | Penven | 428/222 |

FOREIGN PATENT DOCUMENTS

| | | | |
|---|---|---|---|
| 703660 | 2/1965 | Canada | 474/255 |
| 2145365 | 2/1973 | France | 24/33 P |

*Primary Examiner*—James C. Cannon

*Attorney, Agent, or Firm*—Kane, Dalsimer, Sullivan, Kurucz, Levy, Eisele and Richard

[57] ABSTRACT

This invention consists of a pintle for use in closing the pin seam of an on-machine-seamed (OMS) press fabric. The pintle takes the form of a braided, knitted, or ply-twisted yarn whose components are monofilaments of various and/or varying diameter. It has an essentially circular cross section for ease of installation, but will flatten in use to an oblate shape closely conforming to that of the void shape formed by the loops at the end of the press fabric and leaving little or no gap when the seam is closed and under tension. Its porous structure allows the passage of water. In this way, the completed seam will more closely resemble the main body of the press fabric.

19 Claims, 2 Drawing Sheets

POROUS YARN FOR OMS PINTLES

BACKGROUND OF THE INVENTION

1. Field of the Invention

This invention relates to the endless press fabrics used in the press sections of papermaking machines to support, carry, and dewater the wet fibrous sheet as it is being processed into paper. It more specifically relates to seamed, rather than endless, fabrics, and to a method by which its two ends are joined and the seam formed when it is installed on the machine.

2. Background Information

Endless "belts" or fabrics are key components of all three sections (forming, pressing, and drying) of the machines used to manufacture paper products. In a sense, one of their functions can be viewed as comparable to that served by a conveyor belt, because, aside from serving the other key purposes of support and dewatering , they carry the wet fibrous sheet along as it is being converted into a paper product.

In the forming section, the forming fabric is much like a fine mesh screen. The furnish, an aqueous suspension of wood fibers and additives, is deposited onto the forming fabric in this first stage and water begins to drain through its fine mesh, leaving a wet fibrous sheet behind. The sheet is then carried to the next stage, the press section. There, the fabric belt, known in the industry as a press fabric, accepts water pressed from the sheet as it is carried through a series of presses, whose operation, in principle, is to mechanically squeeze water from the sheet into the press fabric. The press fabric, because it has a smooth surface, also imparts such a surface onto the sheet.

Finally, in the dryer section, the drying fabric belts conduct the sheet around and hold it tightly against a series of steam-heated rolls to evaporate the remaining water. For this reason, these fabric belts are usually lighter and thinner and more permeable than those used in the press section because they must allow water vapor to freely pass from the sheet.

Generally, the fabrics used in the press section are supplied in endless form, that is, a fabric woven in the form of an endless loop without a seam. On the other hand, drying fabrics are typically provided in open-ended form and require seaming on the machine when installed. The comparative ease with which an on-machine-seamed (OMS) press fabric can be installed will be our primary concern here. To carry out such an installation, one merely has to draw one end of the open-ended fabric through the machine and around the appropriate guide and tension rolls and other components. Then, the two ends can be joined at a convenient location on the machine and the tension adjusted to make the fabric taut. In fact, a new fabric can be installed at the time an old one is removed. In this case, one end of the new fabric is connected to the old fabric, which is used to pull the new fabric into proper position on the machine.

By way of contrast, the installation of an endless fabric in a press section is a much more difficult and time-fabric consuming undertaking. The machine must, of course, be shut down and the old fabric cut out or otherwise removed. The new fabric then must be slipped into the machine from the side into the spaces between the presses and around other machine components and through spaces in the machine frame. The difficulty is compounded by the fact that the newer generation press fabrics have been becoming increasingly bulkier and stiffer. This increases the time and effort required by plant personnel to install a new one. Viewed in this light, the development of an OMS press fabric is highly desirable.

There are a number of different ways by which a seam might be formed and closed, and which have been used on drying fabrics. One of these ways is the clipper seam, which consists of closely spaced metal hooks at each end of the belt. The seam is formed by clipping the hooks from both ends onto a common metal cable. The resulting seam is a good deal thicker than the body of the fabric and carries with it the disadvantage that the metal hooks eventually corrode and weaken.

Other, non-metallic, seams include the spiral, multifilament, and pin seam. Generally, each involves the joining of the two ends of the belt by running a non-metallic cable through similar loops at each end of the fabric. More specifically, the ends of the fabric are brought closely together in such a way that the loops on one end of the fabric alternate and mesh with those of the other end. Then, the seam is closed by passing a cable or strand through the meshed loops joining the two ends together.

Except for the pin seam, these share one major disadvantage of the clipper seam by being thicker than the rest of the body of the fabric. This is because they involve the addition of other elements onto the ends of the fabric which are then used to close the seam. In addition to increasing the thickness of the fabric at the point of the seam, these added elements are subject themselves to wear and failure and their presence changes the porosity characteristics of the fabric in the region of the seam.

The pin seam, however, is more difficult to distinguish from the rest of the fabric. To close this seam again requires that a cable or strand, the pin, be passed through the meshed loops of each end of the fabric. This can be accomplished in two ways. In the first case the loops are formed by the machine direction strands themselves, looped and woven back into the fabric. The second technique employs the art of weaving "endless", which normally results in a continuous loop of fabric. However, when making a pin-seamable press fabric, one edge of the fabric is woven in such a way that body yarns form loops, one set of alternating loops for each end of the woven cloth. Using these techniques, the seam location will be more nearly the same thickness as the rest of the fabric.

The type of seam used in a drying fabric has not been a matter of major concern. In the drying section, as mentioned above, the fabric conducts the sheet around a series of heated rolls. Tension in the drying fabric is relatively low when compared to that on a press fabric. The drying fabric is not subject to any compression which might otherwise damage the seam. Finally, the risk of sheet-marking by the seam is small at this point, because much of the paper sheet water has been removed.

The thickness of the seam would be a major concern, however, in the press section. If the seam were considerably thicker than the body of the fabric, it would be subject to high compressive forces on each passage through a press. Not only would this lead to damage to the seam and a shortened seam life, but also press roll vibrations could be set up by the repetitive effect of the thick seam passing through. In addition, the wet fibrous sheet, still quite fragile in the press section, would be marked, if not partially or wholly broken, by the higher compressive force at the seam location.

A pin seam, however, can be used in attempting to develop an OMS press fabric without a thickness-related problem. The first open-ended press fabrics using pin seams were closed with pintles, as the pins passing through the loops are called. Used for the same purpose in drying fabrics, they were the same size, solid, round shape, and of the same material. However, as tensions in a press fabric are four to ten times higher than those in a drying fabric, the same pintles were not up to the task of holding the seams intact.

In addition, sheet marking was observed in spite of the use of the pin seam. Investigation disclosed that this was sometimes being caused by the presence of a small gap in the fabric at the location of the seam. This occurred because the pintle did not completely fill the space formed by the loops. As a result, sheet water was not being properly removed from the region of the sheet adjacent to the seam, causing sheet marking. The use of a single large pintle also caused the seam to be considerably thicker under compressive load than the body of the fabric. Two or more slightly smaller diameter pintles were then tried, with some improvement, but not elimination of the problem.

Use of seamed press fabrics also resulted in a new problem. Since the seam is physically and geometrically different from the body of the fabric, liquid flow in the seam area is different. This flow resistance variation allowed instantaneous larger amounts of air to pass through the seam area as the fabric passed over a mechanical dewatering device called a suction box. This caused a loud "popping" noise to occur, causing great concern to the papermachine operating people. Thus, another requirement for the pintle was added.

One attempt to overcome this difficulty consisted of the use of a stuffer yarn with the pintle in order to completely fill the space formed by the loops. This approach, however, was time-consuming and not very effective in preventing the sheet mark or the loud "popping" noise produced by vacuum or air flow surge.

The primary requirements for a successful pintle are a high tensile strength both lengthwise and radially, an ability to withstand radial and shear forces from the loops, and resistance to wear from constant contact with the loops as the fabric flexes and bends around rolls in the fabric run. It must also aid the seam area in resisting sheet mark and the loud "popping" noise as the seam passes over the box. In addition, some degree of porosity is desirable so that the pintle, even when completely filling the space formed by the loops, will have a permeability more like that of the body of the fabric.

Attempts to deal with this problem through the use of single, solid larger diameter round pintles or a pair, or more, of smaller diameter round pintles yielded slight improvement. This is partly because the void to be occupied by the pintle does not have a circular cross-section. Instead, when a load is applied, this void formed by the loops becomes oblate. Therefore, the ideal pintle would have a similarly shaped cross-section and would, in consequence, contribute to a better seam with a lower profile and smaller gaps.

A monofilament, extruded in such a way that its cross section be oblate, would seem to be an appropriate pintle. However, while completing a seam with little or no gap, it would still be subject to the shortcoming of lack of permeability. It is likely then that the sheet will still be marked because of insufficient drainage of water.

Another factor to consider is that the technology of seamed press fabrics has improved in that different weaves, machine-direction (MD) loop yarn sizes and counts have been developed. The seam area therefore is different for different fabrics. Also, these different fabrics will compact somewhat in the base over the running life of the fabric. The degree of compaction depends upon the particular position on which the fabric is installed and its environment and is not predictable. An ideal pintle system therefore is one that will conform to these changes throughout the life of the fabric.

A solution to these problems is represented by a pintle whose structure conforms to the oblate seam area under load and is porous and permeable to water and air, such that the seam area acts like the main body of the fabric as far as the paper sheet is concerned. The present invention provides a pintle satisfying these criteria.

SUMMARY OF THE INVENTION

The present invention is a pintle produced and supplied in the form of a braided or knitted yarn having an essentially round cross section. When subjected to compression, however, it becomes flattened, and the cross section assumes an oval or oblate shape, similar to the shape of the passage formed by the intermeshed loops when the press fabric is subject to tension and compression. In this regard, a ply-twisted pintle, composed of strands of monofilament twisted rather than braided or knitted together, is another form of porous pintle considered by the inventor to fall within the scope of the present invention.

In one embodiment, the yarn is composed of several monofilaments, each of round cross section, ranging from 0.003 to 0.012 inches (3 to 12 mils) in diameter. The braiding, knitting, or ply-twisting process yields a balanced yarn with good integrity. A yarn having a round cross section will be produced when the proper choices of number and diameters of component filaments, and number of picks or crossovers in the braid, or knit, have been made. This round cross section will ensure that the pintle will be easy to install, yet it will still assume the desired oblate shape when subject to compression.

It is well known that braiding or knitting produces a stronger yarn with better textile properties than a single monofilament. It will easily satisfy the requirements of linear, radial and shear strength and resistance to wear. The braiding or knitting process will also allow the individual filaments making up the braid or knit to flex and move while under tension. In this way, fatigue will be minimized.

It is of equal importance that the braided or knitted structure of the pintle be porous and allow fluids to pass through its structure. In this respect, the seam location will have drainage characteristics similar to that of the rest of the fabric. As a result, sheet marking potential is greatly reduced, as well as the loud "popping" noise as the seam of the fabric passes over the suction box.

Features common to more than one figure have given the same identifying numerals.

DESCRIPTION OF THE PREFERRED EMBODIMENT

Figure 1:
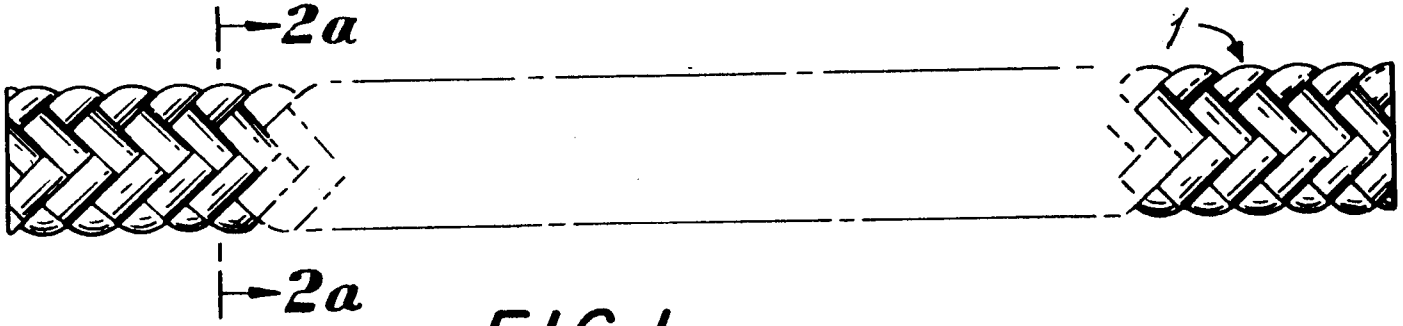
FIG. 1 is a side view of the pintle of this invention. It can be seen to be a interwined yarn of monofilaments.

FIG. 1 shows the pintle 1 of this invention. It takes the form of a braided yarn whose individual strands are monofilaments 2 having diameters falling in a range from 0.003 inches to 0.012 inches (3 to 12 mils). Finer or larger diameter monofilaments could be used depending upon need. While the monofilaments are usually of circular cross-section, other shapes, such as oval, can be used.

Figure 2A:
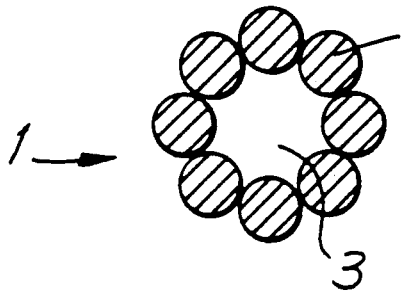
FIG. 2*a* is a cross-sectional view of the pintle as a whole showing it to be essentially circular. In the embodiment shown, the core of the pintle is empty.

FIG. 2*a* is a cross-sectional view of one embodiment of the pintle 1 showing the component filaments 2. This view is taken at the point noted in FIG. 1. In this embodiment, the component monofilaments 2 are interwined to form a composite strand having a hollow, or empty, core 3. The pintle 1 can be seen to have an essentially circular cross-section. The braiding or knitting process producing a pintle 1 with such a cross-section depends upon properly defining the relationship between filament diameter, number of filaments, and number of picks, or crossovers, in the braid.

In the practice of the present invention, 6 or 8 component monofilaments 2 are typically intertwined to form the composite strand. As mentioned previously, the diameters of the component monofilaments 2 typically fall in the range of 3 to 12 mils. In the case of braiding, 16 or 24 picks per inch of the pintle 1 has been found to give satisfactory results. The number of picks, or crossovers, per inch is a measure of the tightness of the braid.

While FIG. 2*a* shows a pintle 1 having component filaments 2 of uniform diameter, it should be understood that the component monofilaments 2 can have varying diameters.

Figure 2B:
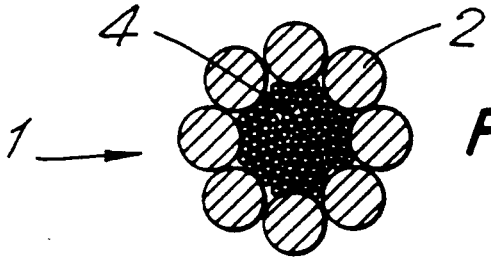
FIG. 2*b* is a cross-sectional view of an alternate embodiment of the present invention where the pintle has a core of spun or bulk continuous filament yarn.

FIG. 2*b* shows a cross-sectional view of another embodiment of the pintle 1 of the present invention. In this case, the component monofilaments 2 have been intertwined around a core 4 of spun yarn or bulk continuous filament. The latter, also knows as BCF, consists of continuous strands of filament that are neither twisted nor spun together. Rather, kinks in the strands of filament provide the means by which the strands in the BCF are held together.

Figure 2C:
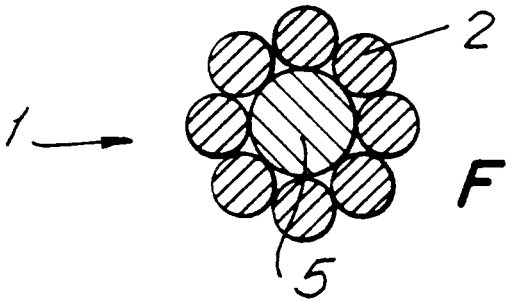
FIG. 2*c* is a cross-sectional view of still another embodiment where the core of the pintle is a monofilament or metal wire.

FIG. 2*c* shows still another embodiment of the pintle 1 of the present invention in cross section. In this case, the component monofilaments 2 have been intertwined around a monofilament strand 5. A metal wire, such as one of stainless steel, could be substituted, in this embodiment, for the monofilament strand 5.

Figure 2D:
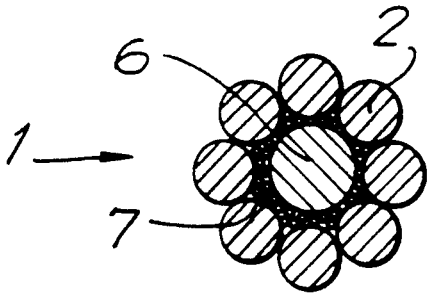
FIG. 2*d* is a cross-sectional view of yet another embodiment where the core of the pintle is a monofilament in combination with spun or bulk continuous filament yarn.

Yet another embodiment can be seen in FIG. 2*d*. Here, the component monofilaments 2 of the pintle 1 are intertwined around a combination of a monofilament strand 6 and a spun or BCF yarn 7.

The present invention is considered to embrace a wide variety of novel pintles, of which those in the following table are but examples:

| Novel Pintles | | |
|---|---|---|
| | Diameter | |
| Type | (mil) | (mm) |
| 8 end braid | 36 | .91 |
| braid/2 × 3 ply core | 55 | 1.4 |
| braid/spun yarn core | 39 | .99 |
| braid/spun yarn core | 46 | 1.1 |
| braid/10 mil stainless steel wire core | 36 | .91 |
| braid/BCF yarn core | 48 | 1.2 |
| braid/BCF yarn & 16 mil monofilament core | 48 | 1.2 |
| braid/spun yarn & 16 mil monofilament core | 52 | 1.3 |

Figure 3:
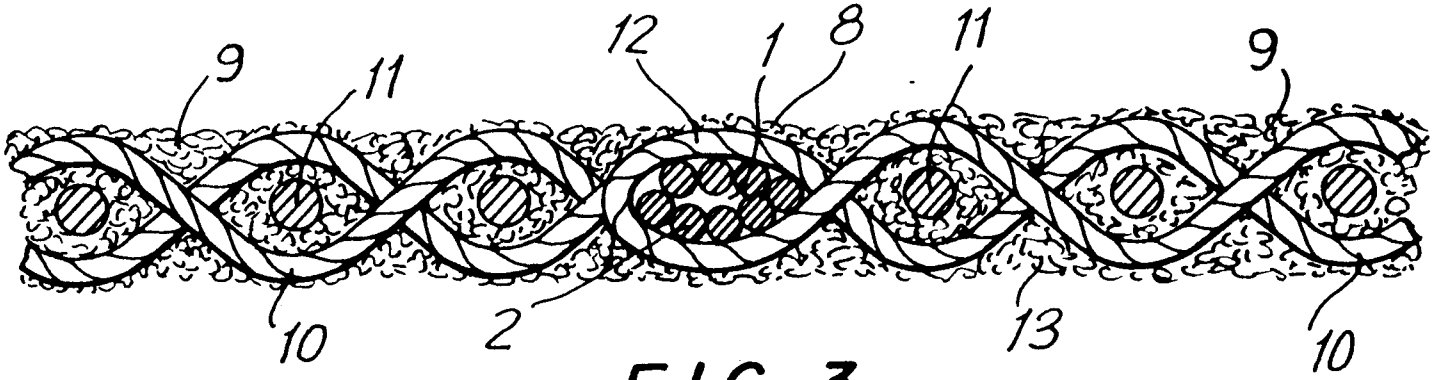
FIG. 3 is a side view of the pintle in place in the fabric used as contemplated in this invention. It is assumed that the seam is under tension and has been subjected to compression. The pintle is shown to be somewhat flattened and to occupy the space created by the loops completely.

FIG. 3 shows the pintle 1 in use in the manner contemplated by this invention, that is, closing a pin seam 8 in a press fabric 9. Machine direction 10 and cross machine direction strands 11 of the press fabric 9 are shown. The loops 12 used to form the pin seam 8 result from the weaving of machine direction strands 10 back into the body of the press fabric 9 by one of several methods. A fibrous batt 13 has been needled into and through the structure of the press fabric 9. The cross-section of the pintle has assumed an oval-shaped or oblate form, which results from its having been subjected to compression. It closely conforms to the shape of the void formed by the loops 12, leaving very little gap between pintle 1 and press fabric 9. The structure of the pintle 1 can be seen to be permeable, allowing the passage of fluid between its individual monofilaments 2. In this way, it closely approximates the behavior of the press fabric 9 itself, and, as a result, the seam 8 will be less likely to cause a mark in the paper product, cause press roll vibrations or result in a loud popping noise as it passes over the suction box.

Modifications would be obvious to one skilled in the art without departing from the scope of the invention as defined in the appended claims.

What is claimed is:

1. A pintle for use in forming a pin seam on a papermachine fabric, said papermachine fabric having two ends and being woven from machine-direction strands and cross-machine direction strands, wherein said machine-direction strands form loops along said two ends, said pin seam being formed by bringing said two ends together, by meshing said loops at said two ends together to define a passage, and by directing said pintle through said passage to prevent said two ends from separating, said pintle having a length at least as long as said papermachine fabric is wide, said pintle being a composite strand formed by intertwining a plurality of individual monofilaments together, said pintle so formed thereby being porous, permeable to fluids, and compressible under load in a direction perpendicular to said length, so that said pintle may completely occupy said passage formed by said loops.

2. A pintle as claimed in claim 1 .wherein said individual monofilaments have diameters in the range from 0.003 to 012 inches (3 to 12 mils).

3. A pintle as claimed in claim 1 wherein said individual monofilaments are intertwined by being braided together.

4. A pintle as claimed in claim 1 wherein said individual monofilaments are intertwined by being knitted together.

5. A pintle as claimed in claim wherein said individual monofilaments are intertwined by being ply-twisted together.

6. A pintle as claimed in claim wherein said individual monofilaments are of more than one diameter.

7. A pintle as claimed in claim 1 wherein said pintle has an essentially circular cross-section.

8. A pintle as claimed in claim 1 wherein said individual monofilaments are of circular cross-section.

9. A pintle as claimed in claim 1 wherein said individual monofilaments are of non-circular cross-section.

10. A pintle as claimed in claim 1 wherein said individual monofilaments are intertwined to form a porous tube, said porous tube having a hollow central core.

11. A pintle as claimed in claim 10 further comprising a 2×3 plied monofilament, said 2×3 plied monofilament being within said hollow central core of said pintle.

12. A pintle as claimed in claim 10 further comprising a spun yarn, said spun yarn being within said hollow central core of said pintle.

13. A pintle as claimed in claim 10 further comprising a multifilament yarn, said multifilament yarn being within said hollow central core of said pintle.

14. A pintle as claimed in claim 10 further comprising a metal wire, said metal wire being within said hollow central core of said pintle.

15. A pintle as claimed in claim 14 wherein said metal wire is a 10 mil strand of stainless steel.

16. A pintle as claimed in claim 10 further comprising a bulk continuous filament yarn, said bulk continuous filament yarn being within said hollow central core of said pintle.

17. A pintle as claimed in claim 10 further comprising a bulk continuous filament yarn surrounding a monofilament strand, said bulk continuous filament yarn surrounding said monofilament strand being within said hollow central core of said pintle.

18. A pintle as claimed in claim 10 further comprising a spun yarn surrounding a monofilament strand, said spun yarn surrounding said monofilament strand being within said hollow central core of said pintle.

19. A pintle as claimed in claim 1 wherein said plurality of individual monofilaments are from 3 to 24 in number.

* * * * *